US005529510A

United States Patent [19]

Wakata et al.

[11] Patent Number: 5,529,510

[45] Date of Patent: Jun. 25, 1996

[54] ROTATABLE CONNECTION TERMINAL FOR CONNECTOR

[75] Inventors: Shigekazu Wakata; Eiji Saijo, both of Yokkaichi, Japan

[73] Assignee: Sumitomo Wiring Systems, Ltd., Mie, Japan

[21] Appl. No.: 251,296

[22] Filed: May 31, 1994

[30] Foreign Application Priority Data

Jun. 22, 1993 [JP] Japan ..... 5-175974

[51] Int. Cl.[6] ..... H01R 13/62

[52] U.S. Cl. ..... 439/310; 439/824

[58] Field of Search ..... 439/29, 289, 310, 439/352, 372, 700, 824

[56] References Cited

U.S. PATENT DOCUMENTS

| | | | |
|---|---|---|---|
| 3,378,810 | 4/1968 | Dorrel . | |
| 3,437,984 | 4/1969 | Yorgensen | 439/700 X |
| 4,083,619 | 4/1978 | McCormick et al. | 439/310 |
| 4,743,201 | 5/1988 | Robinson et al. . | |
| 5,283,499 | 2/1994 | Adam et al. | 439/700 X |

FOREIGN PATENT DOCUMENTS

| | | | |
|---|---|---|---|
| 717334 | 2/1942 | Germany . | |
| 2815330 | 10/1979 | Germany | 439/824 |
| 4-124774 | 11/1992 | Japan . | |
| 4-334908 | 11/1992 | Japan . | |

*Primary Examiner*—Khiem Nguyen
*Attorney, Agent, or Firm*—Oliff & Berridge

[57] ABSTRACT

A spring is wound on a connection terminal with one end thereof fixedly secured to the connection terminal. A spiral protuberance is formed on a bore wall of a holder hole and is engaged with the spring. With this construction, when the connection terminals are to be fitted together, the spring is guided by the spiral protuberance to be angularly displaced, and at the same time, the connection terminal fixed to the spring is also angularly displaced in synchronism therewith. Therefore, even if dust or the like deposits on connection terminals, it can be removed by the rotation of one of the connection terminals during the fitting operation to maintain a good electrical connection.

11 Claims, 3 Drawing Sheets

ROTATABLE CONNECTION TERMINAL FOR CONNECTOR

BACKGROUND OF THE INVENTION

This invention relates to connection terminals for a connector and more particularly, to a connector in which dust or the like is prevented from disturbing the electrical connection.

Generally, male terminals are mounted within one of two connectors that can be fitted together, and female terminals for receiving respective male terminals are mounted within the other connector. The terminals are exposed within their respective connector housings and usually, when the connectors are fitted together, these terminals are held in a fitted condition under a predetermined contact pressure.

In a condition before the connectors are fitted together, however, each terminal is in an exposed condition, and therefore dust or the like sometimes deposits on the terminals. Also, upon lapse of a long period of time, the terminals may become oxidized, so that an oxide film is formed on the surface of the terminal. In such a case, there is a chance that the contact resistance increases, and the function of the connector may be degraded.

SUMMARY OF THE INVENTION

An object of the invention is to provide connection terminals that can overcome the problems of the prior art and can achieve a proper electrically connected condition notwithstanding accumulated dust or the like.

To achieve the above object, the present invention provides connection terminals that are mounted within male and female connectors, respectively, and are fittable together; wherein at least one of the connection terminals is received in a holder hole for displacement in an axial direction and is urged by a spring in a push-out direction; and wherein a spiral passageway is formed in one of an outer peripheral surface of one connection terminal and a bore wall of the holder hole and extends in an axial direction, whereas the other connector is provided with a guide that is engageable with the spiral passageway so as to angularly displace the one connection terminal in accordance with the fitting of the connection terminals.

In another aspect of the invention, at least one of two connection terminals is received in a holder hole for displacement in an axial direction; a spring is wound around the one connection terminal for urging the same in a push-out direction, the spring being secured at one end to the one connection terminal; and a spiral protuberance formed on a bore wall of the holder hole engages a wire element of the spring so as to angularly displace the one connection terminal in accordance with the fitting of the two connection terminals.

In yet another aspect of the invention, a connector is provided comprising a first portion having a terminal receiving recess and a second portion having a terminal rotatably engageable with the terminal receiving recess. The first and second portions remain rotatably stationary when the terminal rotates with respect to the terminal receiving recess.

In still another aspect of the invention, a connector is provided comprising a male terminal formed in a socket of a male housing and a female terminal formed in a female housing, the male and female housings being fittable together in an intermediate fitted position in which the male and female terminals make initial contact, and a complete fitted position in which the male and female terminals are biased toward each other with a predetermined contact pressure; and a device for rotating the male terminal with respect to the female terminal when moving from the intermediate fitted position to the complete fitted position.

With the connector of the above construction, when the connection terminals are fitted together in accordance with the fitting of the two connectors, one connection terminal receives a force in a push-in direction. At this time, the connection terminal is angularly displaced through the engagement between the guide and the spiral passageway, and therefore the terminals are contacted with each other while being rotated relative to each other. Therefore, a wiping effect is obtained, and deposited oxide film, dust and the like are removed. Furthermore, when the connection terminals are to be fitted together, the spring is compressed and is rotated or rolled while its wire element is guided by the spiral protuberance, and therefore dust and the like are similarly removed. At the same time, a predetermined contact pressure between the terminal and the recess is maintained by the spring.

In the present invention, even if an oxide film, dust or the like deposits on a surface of the connection terminal, the connection terminals are rolled or rotated relative to each other during the time when the connectors are fitted together, and therefore a good connected condition can be achieved. A further advantage is that a relative rolling movement between the terminals is effected, utilizing the spiral wire element of the spring that can bias the terminals with each other under a predetermined pressure. Therefore, in addition to the advantageous dust removing effect, there is also an advantageous effect that the construction is simplified.

BRIEF DESCRIPTION OF THE DRAWINGS

The present invention will now be described in detail with reference to the drawings wherein.

DETAILED DESCRIPTION OF PREFERRED EMBODIMENTS

Figure 1:
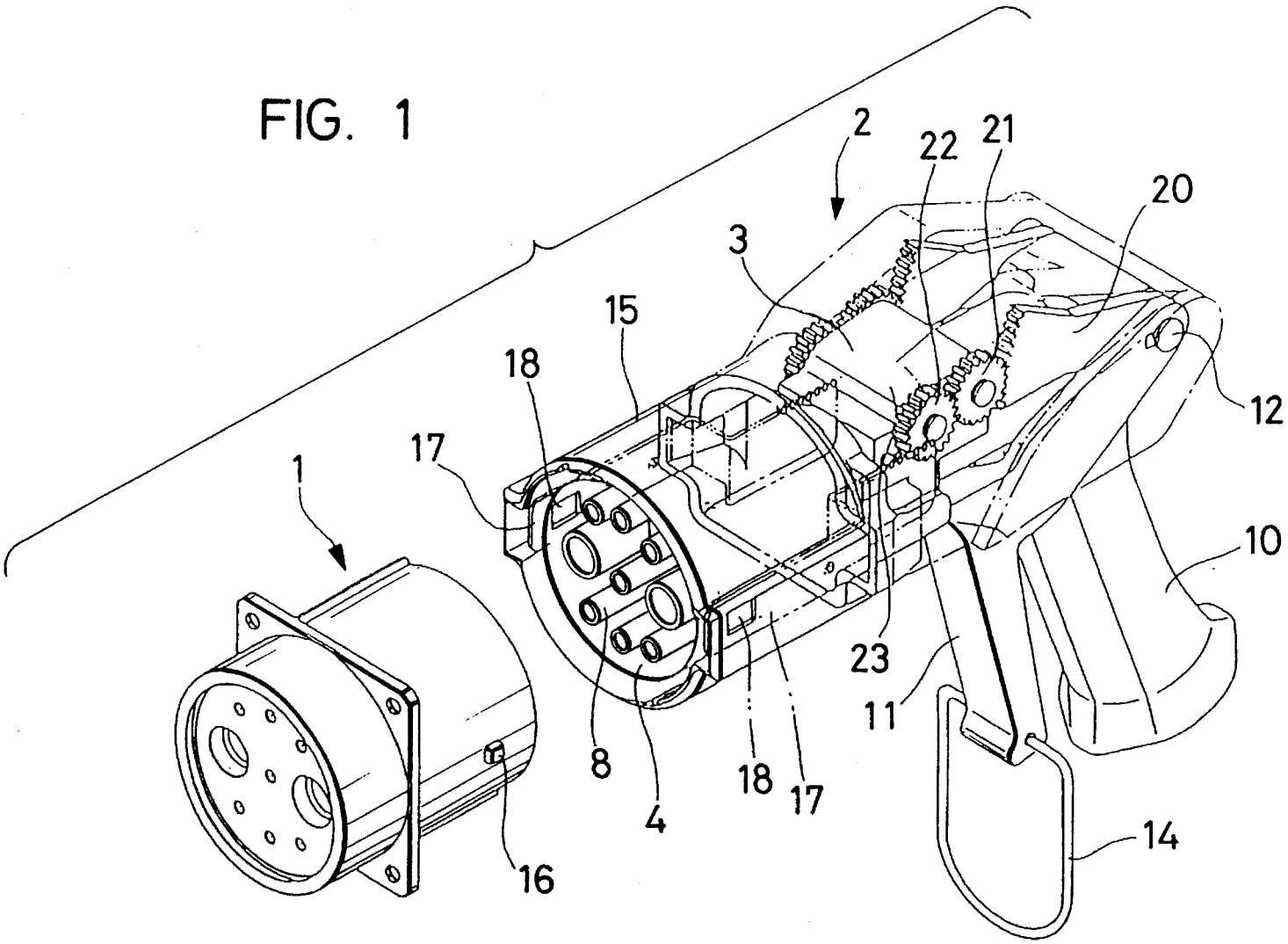
FIG. 1 is a perspective view showing the connector of the invention.
Figure 2:
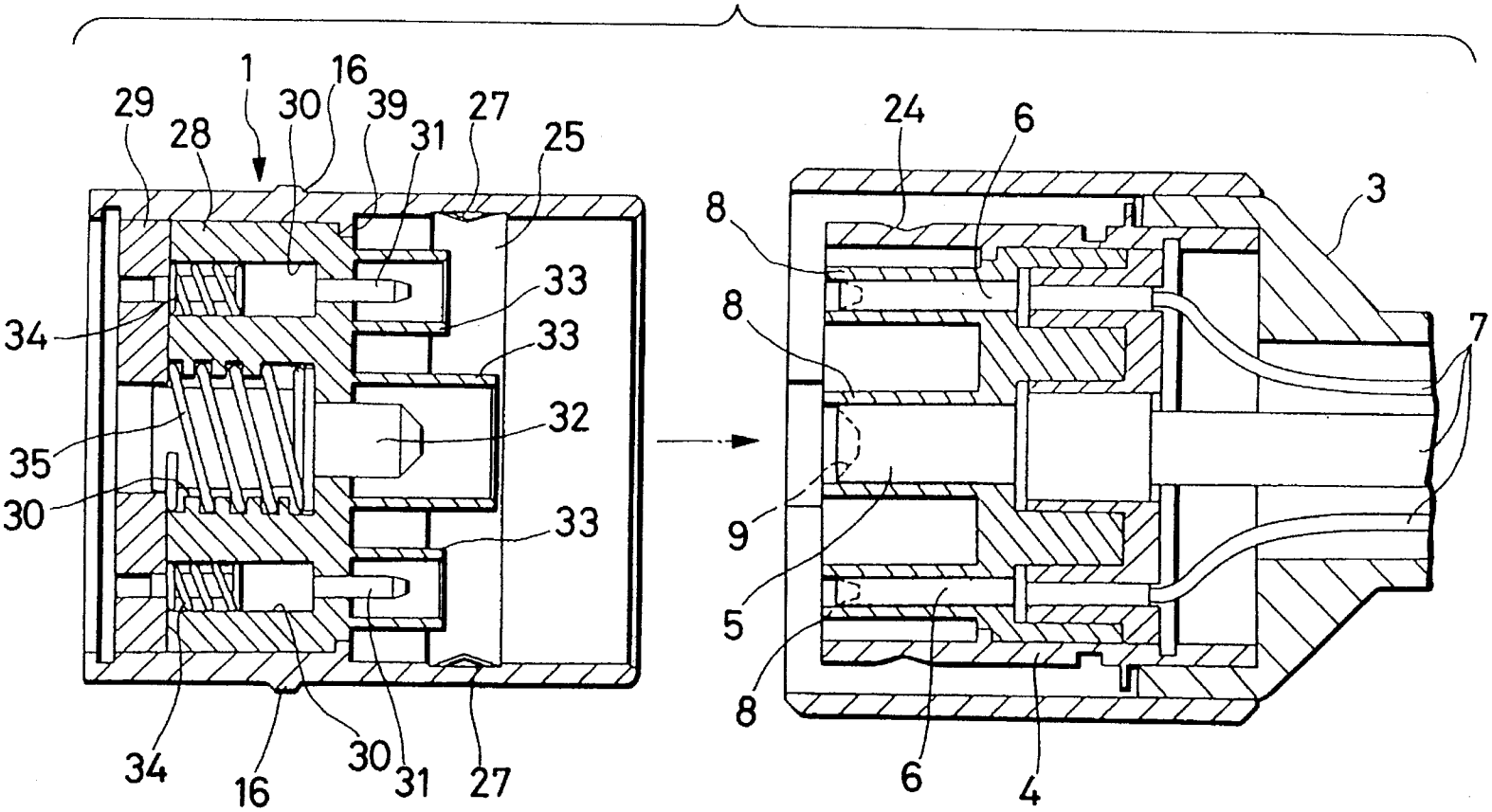
FIG. 2 is a cross-sectional view of two connector portions.

FIG. 1 shows a connector for charging an electric car comprising a car body-side connector I and a charger-side connector 2. Reference is first made to the charger-side connector 2. This connector 2 includes a gun-type body 3 in order to facilitate a fitting operation, and a cylindrical connector housing 4 is provided at a distal end of the body 3. Terminals 5 (one shown) for charging purposes, as well as female terminals 6 for signal lines including signal lines for detecting a charging condition are mounted within the connector housing and are connected to respective cables 7, which in turn, are led out to the exterior of the connector housing. The terminals 5 and 6 are fixedly fitted respectively in inner tubes 8 within the housing 4, and each of the terminals has a bar-like front end portion and a generally cone-shaped recess 9 of a predetermined depth formed in a front end face thereof. Additionally, each terminal can butt against its mating terminal in the car body-side connector 1 to be electrically connected thereto.

A grip 10 is provided at a rear end portion of the body 3, and a lever 11 that can be grippingly manipulated is mounted on an upper portion thereof for pivotal movement about a support pin 12. Although not shown in the drawings, a torsion spring is mounted around the support pin 12 to urge the lever 11 in a returning direction (opening direction). An engagement ring 14 is mounted on a lower end of the lever 11. By engaging the ring 14 with the grip 10, the lever is held in a grasped condition.

An outer peripheral portion of the connector housing 4 is covered by a front cover 15 fitted thereon and generally coaxially therewith. Opposite (right and left) sides of the cover 15 bulge outwardly and extend along the length thereof. A pair of right and left drawing plates 17 are received in respective spaces formed between each bulged portion and the connector housing 4. The pair of drawing plates 17 are engageable with respective projections 16 formed on an outer surface of the car body-side connector 1. Each drawing plate 17 has a window or opening 18 in its front end portion and a rear portion thereof projects rearwardly from the front cover 15 and is bent to extend along the wall of the body 3.

For moving the two drawing plates 17 back and forth, the lever 11 is operatively connected to the two drawing plates 17 through a gear or transmission mechanism. More specifically, a pair of right and left sector gears 20 are supported on the support pin 12 for the lever 11 and can be rotatably moved in response to the gripping of the lever 11. The two sector gears 20 are in mesh with respective first gears 21 rotatably mounted on the body 3. The first gears 21 are in mesh with respective second gears 22 disposed adjacent thereto. The second gears 22 are in mesh with respective rack portions 23 formed on respective rear end portions of each drawing plate 17.

It is desirable to ensure that the charger-side connector 2 is fitted to a proper predetermined depth in the car body-side connector 1. By achieving this result, the charger-side connector 2 can be selectively and provisionally retained, using a ring groove 24 that is engageable with a retaining ring 25 (described later). The ring groove 24 is formed in a predetermined portion of the outer peripheral surface of the housing 4 and extends in the direction of the periphery thereof.

Before the charger-side connector 2 is fitted into this condition, the front end portions of the two drawing plates 17 are normally spread out so that the two drawing plates 17 will not interfere respectively with the two projections 16 on the car body-side connector 1. In the above intermediate fitted or provisionally-retained position, when the lever 11 is grippingly manipulated to retract the two drawing plates 17 slightly, the front end portions of the two drawing plates 17 move toward each other in a known manner so that the windows 18 can be brought into registry with the respective projections 16. This can be achieved, for example, by a construction in which the two drawing plates, though normally held in contact with the outer peripheral surface of the housing, become received in respective grooves formed in the outer surface of the housing along the length thereof when the retracting operation begins.

The car body-side connector 1 will now be described. A housing 1 has a cylindrical shape and can fit on the housing 4 of the charger-side connector. The retaining ring 25 is fittingly mounted on the housing 1 at a position spaced a predetermined distance from a front end of the housing. Elastically-deformable claws 27 are formed by stamping on suitable portions of the retaining ring 25, and for example, two such claws 27 are formed at symmetrically-disposed portions. The two claws can be resiliently engaged in the ring groove 24 in the charger-side connector 2, thereby provisionally retaining the charger-side connector 2.

A terminal holder 28 is inserted into the car body-side connector 1 from a rear side thereof until it is abutted against a flange 39. The terminal holder 28 is prevented by a retainer 29 from withdrawal, the retainer 29 being fitted in the connector and disposed rearwardly of the terminal holder 28. Holder holes or sockets 30 are formed through the terminal holder 28 and are so arranged as to be in registry with the terminals 5 and 6, respectively. Male terminals 31 for signal lines and male terminals 32 for charging purposes are received respectively in these holder holes in such a manner that the male terminals can be displaced in an axial direction. Outer tubes 33 provided respectively for the terminals 31 and 32 are formed integrally on and extend from the front face of the terminal holder 28.

Front end portions of the terminals 31 and 32 are inserted respectively into the outer tubes 33. When the two connectors 1 and 2 are fitted together, the outer tubes 33 fit respectively over their mating inner tubes 8 of the charger-side connector 2. Each terminal 31 is urged by respective springs 34 received in its respective holder hole 30 in a push-out direction. With this arrangement, a predetermined contact pressure is obtained between each terminal 31 and its mating terminal 6 of the charger-side connector 2.

Figure 3:
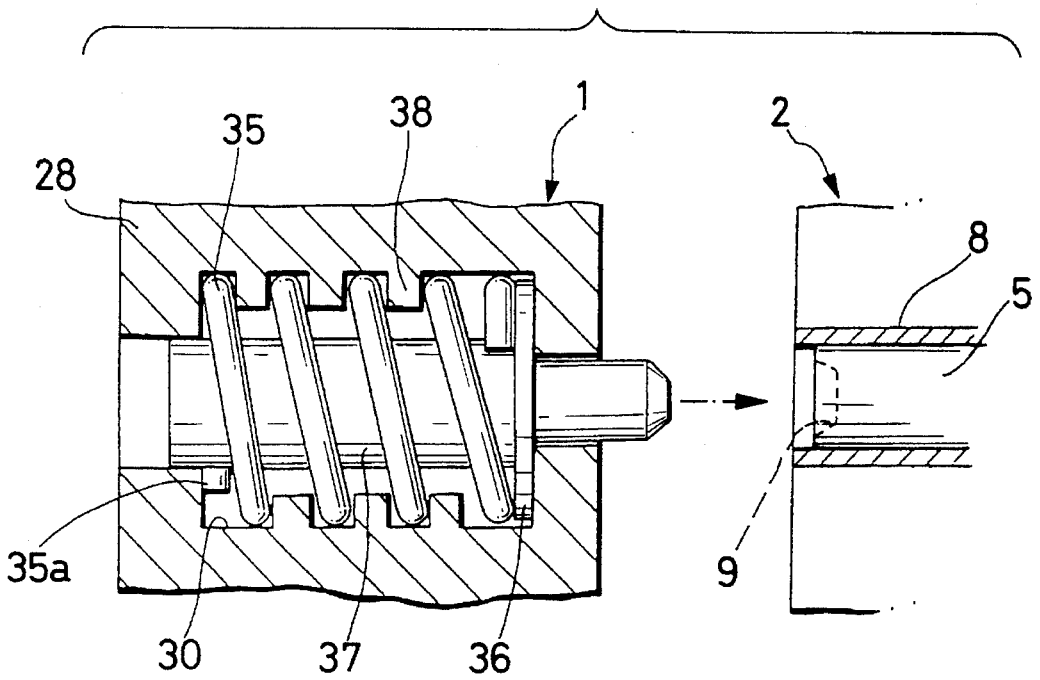
FIG. 3 is an enlarged cross-sectional view of a portion of the connection terminals.
Figure 4:
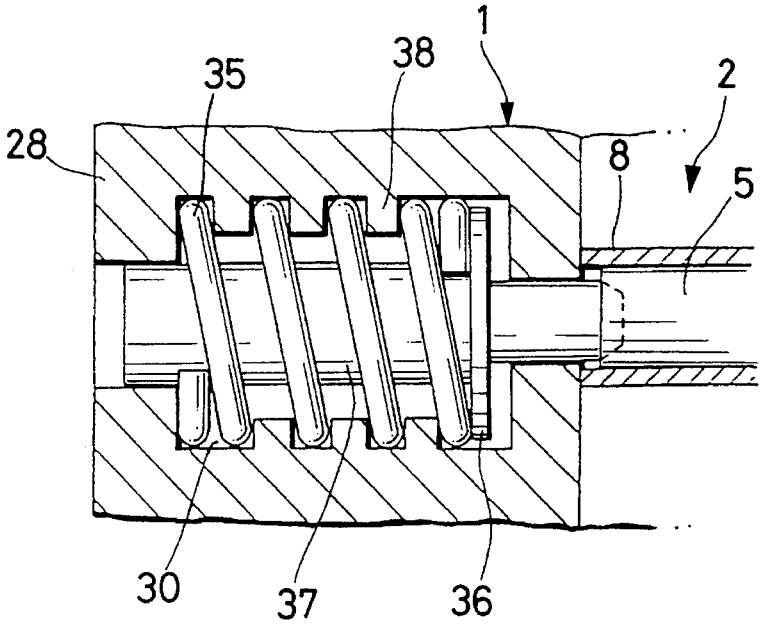
FIG. 4 is an enlarged cross-sectional view of the terminals in a connected condition.

A flange 36 is formed integrally on a generally central portion of each charging terminal 32, and that portion of the terminal 32 extending rearwardly from the flange 36 defines a larger-diameter portion 37. A spring 35 is wound around the larger-diameter portion 37, and one end of the spring 35 is fixedly secured to the flange 36, whereas the other or free end of the spring is abutted against the front face of the retainer 29. As shown in FIGS. 3 and 4, a spring seat or spring base **35*a* at the rear end of the spring 35 is formed shorter than usual so as to allow an angular displacement of the spring without interference between the spring seat 35*a* and spring 35 when it is twisted and compressed. A spiral protuberance 38 is formed on a bore wall of the holder hole 30 and is engaged with a follower such as a wire element or coil of the spring 35 over a predetermined range or distance. With this arrangement, during the time when the charging terminals 5 of the connector 2 are brought into electrical connection to the charging terminals 32 of the connector 1, respectively, each charging terminal 32 of the car body-side connector 1 is retracted so that the charging terminal 32 is angularly displaced by a predetermined angle through the engagement of the spring 35 with the spiral protuberance 38**.

Next, the operation and effects of the above construction will now be described. For fitting the two connectors 1 and 2 together, the grip 10 is grasped, and the charger-side connector 2 is brought into registry with the car body-side connector 1 and pushed thereinto. When the charger-side connector 2 is inserted into a position of a predetermined depth, the claws 27 of the retaining ring 25 are resiliently engaged in the ring groove 24 so that the charger-side connector 2 is provisionally retained in this position (half-fitted or intermediate fitted position). In this condition, the lever 11 is lightly gripped to be manipulated, and the two drawing plates 17 are slightly retracted through the meshing engagement of the sector gears 20 and the first and second gears 21 and 22. As a result, the front end portions of the two drawing plates 17 are moved toward each other, and the two windows 18 are brought into registry with and engaged with the two projections 16, respectively. When the lever 11 is further gripped to be manipulated, the car body-side connector 1 is drawn to break the engagement of the claws 27 in the ring groove 24 so that the charger-side connector 2 advances, causing the terminal 32 to rotate with respect to the recess 9. As a result, the two connectors 1 and 2 are completely fitted together.

At this time, the outer tubes 33 of the car body-side connector 1 fit on the inner tubes 8 of the charger-side connector 2, respectively, and therefore the mating terminals are electrically connected together in a butted condition with a predetermined contact pressure applied by the springs 34 and 35.

When the terminals 5 of the charger-side connector 2 are abutted against the charging terminals 32 of the car body-side connector 1, respectively, each of the terminals 32 is pushed back against the bias of the spring 35. Therefore, because of the engagement between the wire element of the spring 35 and the spiral protuberance 38, the spring 35 is guided by the spiral protuberance 38 to be retracted while being twisted (spirally retracted). Since the one end of the spring 35 is fixedly secured to the flange 36 as described above, they are in an integrally-connected condition, and therefore, each of the charging terminals 32 of the car body-side connector is angularly displaced in the same direction as the direction of spiral retraction of the spring 35. Namely, the terminal 32 is fitted in the terminal 5 of the charger-side connector 2 while being rotated, and therefore, relative twisting between the tip of the charger terminal 37 and the core shaped recess creates a wiping effect. Therefore, even if dirt deposits on the surface of the terminal 32 or the recess 9, or even if an oxide film is formed on this surface, they are removed through the fitting operation and a good contact condition can be always achieved without the need for any particular cleaning operation.

After the charging operation is finished, the charger-side connector 2 is disengaged in the order reverse to the above order, and the terminals 6 for signal lines are returned by the springs 34 to their respective initial positions. Also, the springs 35 are returned while undoing the twisting (that is, spirally advanced), and therefore, the charging terminals 32 are angularly displaced in the returning direction in synchronism therewith.

While the invention has been described in detail with reference to preferred embodiments thereof, which are intended to be illustrative but not limiting, various modifications of the present invention may be made without departing from the spirit and scope of the invention. For example, in this embodiment, although the terminals are angularly displaced utilizing the spiral structure of the spring, this may be replaced by a construction in which a spiral groove is formed in the terminal 32 and a protuberance is formed in the bore wall of the holder hole that engages the spiral groove. Also, the means for guiding the angular displacement is not required to be provided over the entire circumference and may be formed on only part thereof. Furthermore, the invention may be applied not only to the charging terminals, but also to the terminals for signal lines and may also be applied to the terminals of the charger-side connector.

The use of the present invention is not limited to the connector for charging an electric car, and the invention can also be applied to a wide variety of connector terminals of the general type.

What is claimed is:

1. A connector comprising:

a connector body having a terminal holder hole formed in the connector body, the terminal holder hole having a spiral passageway formed in a bore wall of said terminal holder hole, said spiral passageway extending in an axial direction, a connection terminal disposed in the terminal holder hole, and a coil spring disposed in the terminal holder hole for urging the connection terminal in a push-out direction and engageable with said spiral passageway to angularly displace said connection terminal in accordance with a fitting of said connection terminal when the connection terminal is axially displaced in a direction opposite the push-out direction.

2. A connector comprising:

a connector body having a holder hole;

a connection terminal disposed in the holder hole; and a spring disposed in the holder hole and wound around said connection terminal for urging said connection terminal in a push-out direction, said spring being secured at one end to said connection terminal; wherein said spring engages with a spiral protuberance formed on a bore wall of said holder hole to angularly displace said connection terminal in accordance with a fitting of said connection terminal when the connection terminal is axially displaced in a direction opposite the push-out direction.

3. A connection device comprising:

a first portion having a terminal receiving recess and a pair of retractable drawing plates, each of the retractable drawing plates having a window formed therein and being axially moveable relative to the first portion, and a second portion having a terminal rotatably engageable with the terminal receiving recess and a pair of projections, each projection engaging with a corresponding window, wherein said first and second portions remain rotatably stationary with respect to one another when the terminal engages with and rotates with respect to the terminal receiving recess as the drawing plates engage with the projections and retract, forcing the first and second portions together.

4. A connection device comprising:

a first portion having a terminal receiving recess; and a second portion having a terminal and a coil spring connected to the terminal, the terminal and coil spring disposed in a socket formed in the second portion, the socket having a groove engaging with the coil spring;

wherein the first and second portions remain rotatably stationary with respect to each other when the terminal engages with and rotates relative to the terminal receiving recess.

5. The connection device of claim 4, wherein a flange is connected to the terminal and the coil spring.

6. The connection device of claim 4, wherein the spring includes a first coil end forming a base seat coil that is engageable with a base of the socket and a second coil end connected to a flange connected to the terminal, wherein the base seat coil is shorter than the second coil end.

7. The connection device of claim 3, further comprising a transmission mechanism including gears operatively connected to a reciprocating sector gear, said sector gear being operable to selectively retract the drawing plates through interaction between said gears and a rack formed on each of the drawing plates.

8. The connection device of claim 7, wherein said sector gear is operatively connected to a lever that is pivotably operated to reciprocate the drawing plates.

9. The connection device of claim 3, wherein the first portion includes a first housing including a retaining ring including at least one elastically deformable claw, and the second portion includes a second housing having a ring groove engageable with the at least one claw.

10. A connector comprising:

a male terminal disposed in a socket formed in a male housing, the socket having a groove formed therein;

a coil spring connected to the male terminal and engaging with the groove; and a female terminal formed in a female housing;

wherein said male and female housings fit together in an intermediate fitted position in which said male and female terminals make initial contact and a complete fitted position in which the male and female terminals are biased toward each other with a predetermined contact pressure, the male terminal being rotated with respect to the female terminal by coils of the coil spring following the groove and being compressed and rotated when the male and female terminals move from the intermediate fitted position to the complete fitted position.

11. The connector of claim 10, wherein a first end coil of the coil spring is shorter than a second end coil of the coil spring.

* * * * *